US005285063A

United States Patent [19]

Schwartz et al.

[11] Patent Number: 5,285,063

[45] Date of Patent: Feb. 8, 1994

[54] METHOD OF DETECTING IONS IN AN ION TRAP MASS SPECTROMETER

[75] Inventors: Jae C. Schwartz; John N. Louris, both of Santa Clara County, Calif.

[73] Assignee: Finnigan Corporation, San Jose, Calif.

[21] Appl. No.: 67,161

[22] Filed: May 24, 1993

Related U.S. Application Data

[63] Continuation of Ser. No. 889,824, May 29, 1992, abandoned.

[51] Int. Cl.[5] ..... H01J 49/42

[52] U.S. Cl. ..... 250/282; 250/291; 250/292

[58] Field of Search ..... 250/292, 291, 282

[56] References Cited

U.S. PATENT DOCUMENTS 4,540,884 9/1985 Stafford et al. ..... 250/282

5,089,703 2/1992 Schoen et al. ..... 250/292

*Primary Examiner*—Jack I. Berman

*Attorney, Agent, or Firm*—Flehr, Hohbach, Test, Albritton & Herbert

[57] ABSTRACT

A method is disclosed for operating an ion trap mass spectrometer in such a way as to distinguish resonantly ejected ions from non-resonantly ejected ions. A supplementary AC field is superimposed on the three-dimensional quadrupole trapping field and the combined fields are scanned to resonantly eject ions of consecutive mass-to-charge ratio. The ejected ions are detected and the output signal of the resonantly ejected ions has a frequency component at the frequency of the supplementary AC field.

18 Claims, 16 Drawing Sheets

FIG.−2

METHOD OF DETECTING IONS IN AN ION TRAP MASS SPECTROMETER

This is a continuation of application Ser. No. 07/889,824 filed on May 29, 1992, now abandoned.

BRIEF DESCRIPTION OF THE INVENTION

This invention relates to a method of detecting the ions in an ion trap mass spectrometer, and more particularly to a method of detecting resonantly ejected ions in an ion trap mass spectrometer.

BACKGROUND OF THE INVENTION

Ion trap mass spectrometers, or quadrupole ion stores, have been known for many years and described by several authors. They are devices in which ions are formed and contained within a physical structure by means of electrostatic fields such as r.f., DC and a combination thereof. In general, a quadrupole electric field provides an ion storage region by the use of a hyperbolic electrode structure or a spherical electrode structure which provides an equivalent quadrupole trapping field.

The storage of ions in an ion trap is achieved by operating trap electrodes with values of r.f. voltage V and associated frequency f, DC voltage U, and device size $r_0$ and $z_0$ such that ions having mass-to-charge ratios within a finite range are stably trapped inside the device. The aforementioned parameters are sometimes referred to as trapping parameters and from these one can determine the range of mass-to-charge ratios that will permit stable trajectories and the trapping of ions. For stably trapped ions the component of ion motion along the axis of the trap may be described as an oscillation containing innumerable frequency components, the first component (or secular frequency) being the most important and of the lowest frequency, and each higher frequency component contributing less than its predecessor. For a given set of trapping parameters, trapped ions of a particular mass-to-charge ratio will oscillate with a distinct secular frequency that can be determined from the trapping parameters by calculation. In an early method for the detection of trapped ions, these secular frequencies were determined by a frequency-tuned circuit which coupled to the oscillating motion of the ions within the trap and allowed the determination of the mass-to-charge ratio of the trapped ions (from the known relationship between the trapping parameters, the frequency, and the m/z) and also the relative ion abundances (from the intensity of the signal).

Although quadrupole ion traps were first used as mass spectrometers over thirty years ago, the devices had not gained wide use until recently because the early methods of mass analysis were insufficient, difficult to implement, and yielded poor mass resolution and limited mass range. A new method of ion trap operation, the "mass-selective instability mode" (described in U.S. Pat. No. 4,540,884), provided the first practical method of mass analysis with an ion trap and resulted in the wide acceptance and general use of ion trap mass spectrometers for routine chemical analysis. In this method of operation, which was used in the first commercially-available ion trap mass spectrometers, a mass spectrum is recorded by scanning the r.f. voltage applied to the ring electrode whereby ions of successively increasing m/z are caused to adopt unstable trajectories and to exit the ion trap where they are detected by an externally mounted detector. The presence of a light buffer gas such as helium at a pressure of approximately $1.3\times10^{-1}$ Pa was also shown to enhance sensitivity and resolution in this mode of operation.

The capabilities of quadrupole ion traps have continued to expand since the development of the mass-selective instability modes of operation described above. The versatility of these relatively simple mass spectrometers has been demonstrated by their high sensitivity in both electron and chemical ionization and their ability to serve as gas-phase ion/molecule reactors. The successful introduction of externally produced ions into these devices has even allowed the study of biomolecules using such techniques as laser desorption, cesium ion desorption, and electrospray ionization. The ion storage ability of the quadrupole ion trap makes possible tandem mass spectrometry (MS/MS) (U.S. Pat. No. 4,736,101) involving many stages of mass analysis with efficient dissociation of ions. Even parent MS/MS scans have been reported. The usable mass range of these mass spectrometers has been extended to 45,000 daltons (for singly charged ions) and beyond.

Although the mass-selective instability of operation was successful, a newer method of operation, the "mass-selective instability mode with resonance ejection" (described in U.S. Pat. No. 4,736,101) proved to have certain advantages such as the ability to record mass spectra containing a greater range in abundances of the trapped ions. In this method of operation, a supplementary field is applied across the end cap electrodes and the magnitude of the r.f. field is scanned to bring ions of successively increasing m/z into resonance with the supplementary field whereby they are ejected and detected to provide a mass spectrum. Commercially-produced ion trap mass spectrometers based on this mode of operation have recently become available, and these instruments have been successfully applied to an even wider variety of problems in chemical analysis than their predecessors.

Most recently, the mass resolution of the ion trap mass spectrometer has been extended by an improvement of the mass-selective instability mode using resonance ejection. In the improved mode, the electrical field is scanned in such a way that ions are brought into resonance, ejected, and detected at a rate such that the time interval between the ejection of successive m/z values is at least 200 times the period of the resonance frequency. This technique has allowed the ion trap to be used to distinguish isobaric ions and to resolve or partially resolve peaks due to multiply charged ions of successive masses. Although the resonance ejection enhancement of the mass selective instability scan allows an increased mass range and mass resolution, artifact peaks are often present in such spectra because of ejection from sources other than resonance ejection at the applied frequency.

In the mass selective instability scan (without resonance ejection), the field within the trap is scanned in such a way that the trapped ions encounter a region of instability so that they are sequentially ejected. In the first commercial instruments, the RF field was scanned linearly with time (no DC field being used) and the ions were ejected as they crossed the boundary of the Mathieu stability diagram, FIG. 2, at $a_z=0$ and $q_z=0.908$. Under these conditions the ions become unstable at the boundary and oscillate at a frequency of one half the RF frequency ($\beta_z=1$). When resonance ejection was introduced to commercial instruments, the RF field was scanned in a similar way but a supplementary AC voltage with a frequency of only slightly less than one half the RF frequency was applied across the trap's end cap electrodes. Ions were ejected as they crossed the beta line associated with the resonance frequency, a beta value only slightly less than 1. Because this beta value was so close to the frequency associated with the edge of the stability diagram, there was little possibility that ions could exist at beta values between the value associated with the resonance frequency and the edge of the stability diagram.

However, whenever a resonance frequency is used that is significantly lower than one half the RF frequency, the possibility exists that ions may be ejected at either the resonance point or at the edge of the stability diagram as the RF field is scanned. In particular, in the "extended mass range" operation of the trap, the resonance frequency may be less than ten per cent of the value associated with a beta of 1, and a large range of q values exists between the q value associated with the resonance point and the q value of the edge of the stability diagram. This results in an occasional peak appearing at a place in the spectrum that is not expected from the calibration of the m/z scale (prepared from ions that are all ejected by resonance ejection). The m/z value of such an anomalous peak will therefore be assigned incorrectly.

In practice, these anomalous peaks occur with sufficient frequency to lead to considerable confusion in the assignment of mass scale. Many sources of anomalous peaks have been identified and encountered. The simplest cause of these anomalous peaks is applying the resonance ejection voltage at a time when ions are present with a $q_z$ between the edge of the stability diagram and the $q_z$ associated with the resonance ejection frequency. Also, occasionally only part of the ion population is ejected during the scan through the frequency of the resonance ejection voltage. The highest m/z resolution is attained with a lower ejection voltage, but a lower voltage also leads to a decreased ejection efficiency. Any ions that are not ejected remain in the trap until the RF voltage is increased to the point that the ions encounter the edge of the stability diagram. Ejection at the edge of the stability diagram is very efficient, and the mass spectrum will therefore show two different peaks arising from ions of the same m/z value. In such a case, we refer to the second peak (arising at the edge of the stability diagram) as a "ghost peak".

When using a trap of sufficiently distorted geometry (i.e., with an electric field sufficiently different from a pure quadrupole field), ejection may occur within the region of stability at well defined "non-linear resonance" lines, such as at $\beta_z=\frac{2}{3}$ or $\beta_z+\beta_r=1$ (depending on the details of the geometric distortion). With such a trap, a ghost peak could arise from ions that survive resonance ejection, but are ejected as they cross the region of non-linear resonance, where ejection may occur without the application of a resonance voltage.

Anomalous peaks are frequently caused by ions created during the resonance ejection process. The resonance ejection scan is quite similar to the method used to fragment ions within the trap to obtain a ms/ms spectrum. Thus, fragment ions are sometimes created as the ions being ejected collide with the buffer gas. These daughter ions usually have m/z values less than that of the parent ion so that they are created with $q_z$ values between the value associated with the resonance ejection voltage and the $q_z$ value of the edge of the stability diagram. (Daughter ions of multiply-charged parent ions have even been observed with a m/z value of greater than the m/z of their parent, because of a loss of a charge during fragmentation. Such ions do not necessarily cause anomalous peaks because they are created with a $q_z$ of less than the value associated with the resonance ejection voltage.)

Anomalous peaks are also caused by ions created during the scan by processes other than dissociation during resonance ejection. Certain ions, especially multiply charged ions, spontaneously dissociate to product ions of lower m/z value. Chemical processes such as charge-exchange ionization may produce ions of lower m/z value. Other types of ion/molecule reactions are also frequently encountered in which ions are created that will be ejected at the edge of the stability diagram rather than at the $q_z$ associated with the resonance ejection voltage.

In a mass spectrum acquired using the mass selective instability mode with resonance ejection, those peaks arising from resonance ejection must be distinguished from those arising from ejection at the edge of the stability diagram, or at non-linear resonance lines, before the m/z value can be determined with complete confidence. We have discovered that the fine structure of the two different types of peaks may be used to distinguish them from one another.

OBJECTS AND SUMMARY OF THE INVENTION

It is an object of this invention to provide a method of operating an ion trap mass spectrometer so that mass spectral peaks arising from resonance ejection may be distinguished from peaks arising from ejection at the edge of the stability diagram or at a line of nonlinear resonance.

It is a further object of this invention to provide a method of operating an ion trap in which peaks arising from ejection at a particular resonance frequency may be distinguished from those arising from ejection at a different resonance frequency, during experiments in which more than one resonance ejection frequency is applied.

It is a further object of this invention to use the fine structure of the mass spectral peaks to enhance the signal to noise ratio of the mass spectral peaks.

BRIEF DESCRIPTION OF THE DRAWINGS

Operation of an ion trap to achieve the above and other objects of the invention will be clearly understood when the following description is read in conjunction with the accompanying drawings of which:

FIG. 11 shows the result of three different digital data processing procedures on a mass spectrum acquired using a wide bandwidth electrometer and data acquisition system. The spectrum was acquired using two resonance ejection frequencies (30 kHz and 100 kHz) as shown in FIG. 10. The peaks between 3.4 ms and 5.4 ms are ejected at the 30 kHz resonance point and the peaks between 12.0 ms and 14 ms are ejected at the 100 kHz resonance point.

FIG. 12*a*, voltage $=+\sin(30000*2\pi*t)+5\sin(100000*2\pi*t)$.

DESCRIPTION OF PREFERRED EMBODIMENT

Figure 1:
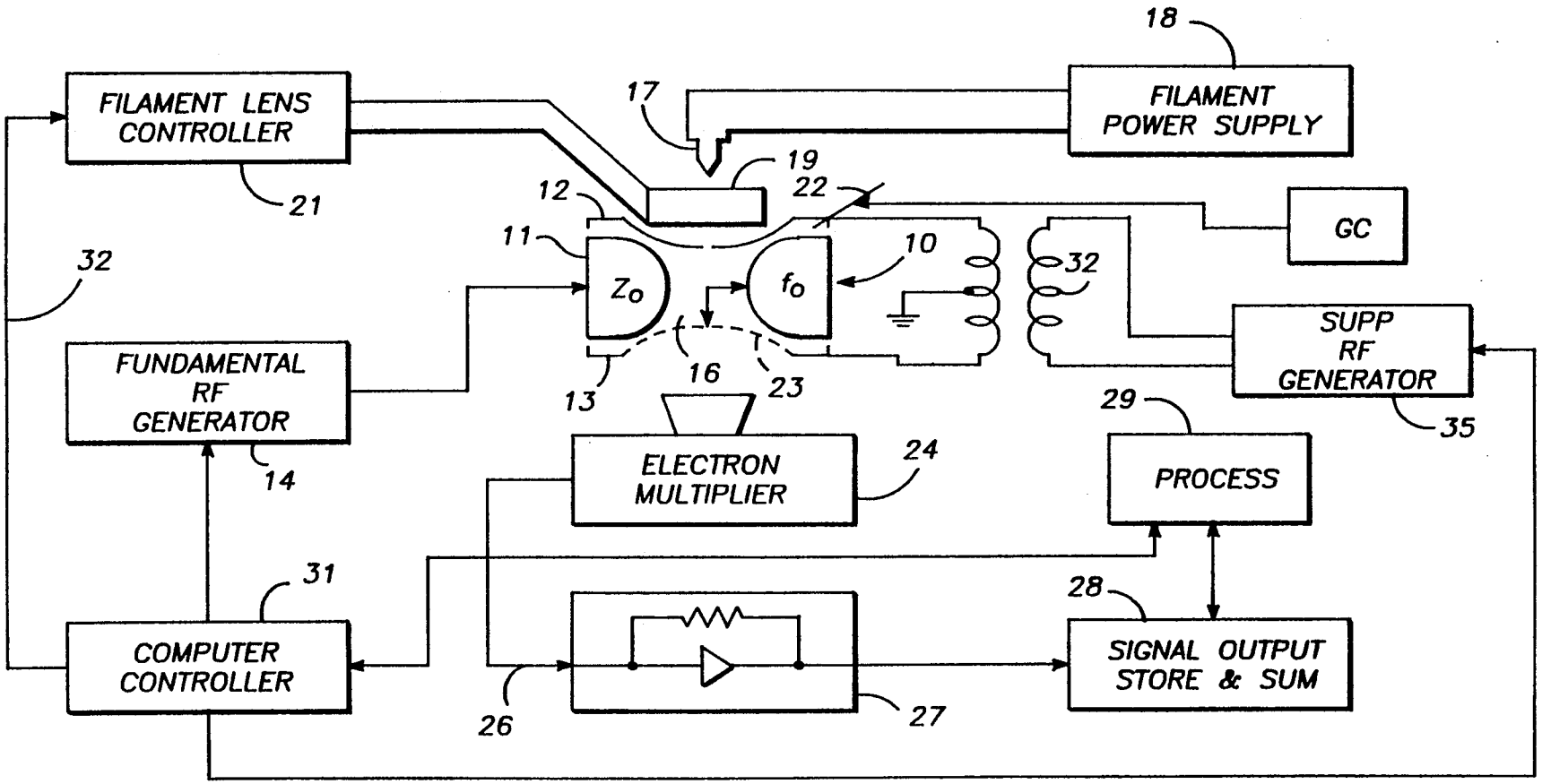
FIG. 1 is a simplified schematic of a quadrupole ion trap mass spectrometer along with a block diagram of associated electrical circuits for operating the mass spectrometer in accordance with the invention.

There is shown in FIG. 1 at 10 a three-dimensional ion trap which includes a ring electrode 11 and two end caps 12 and 13 facing each other. A radio frequency voltage generator 14 is connected to the ring electrode 11 to supply an r.f. voltage V sin $\omega t$ (the fundamental voltage) between the end caps and the ring electrode which provides a substantially quadrupole field for trapping ions within the ion storage region or volume 16. The field required for trapping is formed by coupling the r.f. voltage between the ring electrode 11 and the two end-cap electrodes 12 and 13 which are common mode grounded through coupling transformer 32 as shown. A supplementary r.f. generator 35 is coupled to the end caps 22, 23 to supply a radio frequency voltage between the end caps. A filament 17 which is fed by a filament power supply 18 is disposed which can provide an ionizing electron beam for ionizing the sample molecules introduced into the ion storage region 16. A cylindrical gate lens 19 is powered by a filament lens controller 21. This lens gates the electron beam on and off as desired. End cap 12 includes an aperture through which the electron beam projects.

Rather than forming the ions by ionizing sample within the trap region 16 with an electron beam, ions can be formed externally of the trap and injected into the trap by a mechanism similar to that used to inject electrons. In FIG. 1, therefore, the external source of ions would replace the filament 17 and ions, instead of electrons, are gated into the trap volume 16 by the gate lens 19. The appropriate potential and polarity are used on gate lens 19 in order to focus ions through the aperture in end-cap 12 and into the trap. The external ionization source can employ, for example, electron ionization, chemical ionization, cesium ion desorption, laser desorption, electrospray, thermospray ionization, particle beam, and any other type of ion source. In our apparatus, the external ion source region is differentially pumped with respect to the trapping region.

The opposite end cap 13 is perforated 23 to allow unstable ions in the fields of the ion trap to exit and be detected by an electron multiplier 24 which generates an ion signal on line 26. An electrometer 27 converts the signal on line 26 from current to voltage. The signal is summed and stored by the unit 28 and processed in unit 29.

Controller 31 is connected to the fundamental r.f. generator 14 to allow the magnitude and/or frequency of the fundamental r.f. voltage to be scanned to bring successive ions towards resonance with the supplementary field applied across the end caps for providing mass selection. The controller 31 is also connected to the supplementary r.f. generator 35 to allow the magnitude and/or frequency of the supplementary r.f. voltage to be controlled. The controller on line 32 is connected to the filament lens controller 21 to gate into the trap the ionizing electron beam or an externally formed ion beam only at time periods other than the scanning interval. Mechanical details of ion traps have been shown, for example, U.S. Pat. No. 2,939,952 and more recently in U.S. Pat. No. 4,540,884 assigned to the present assignee.

Figure 2:
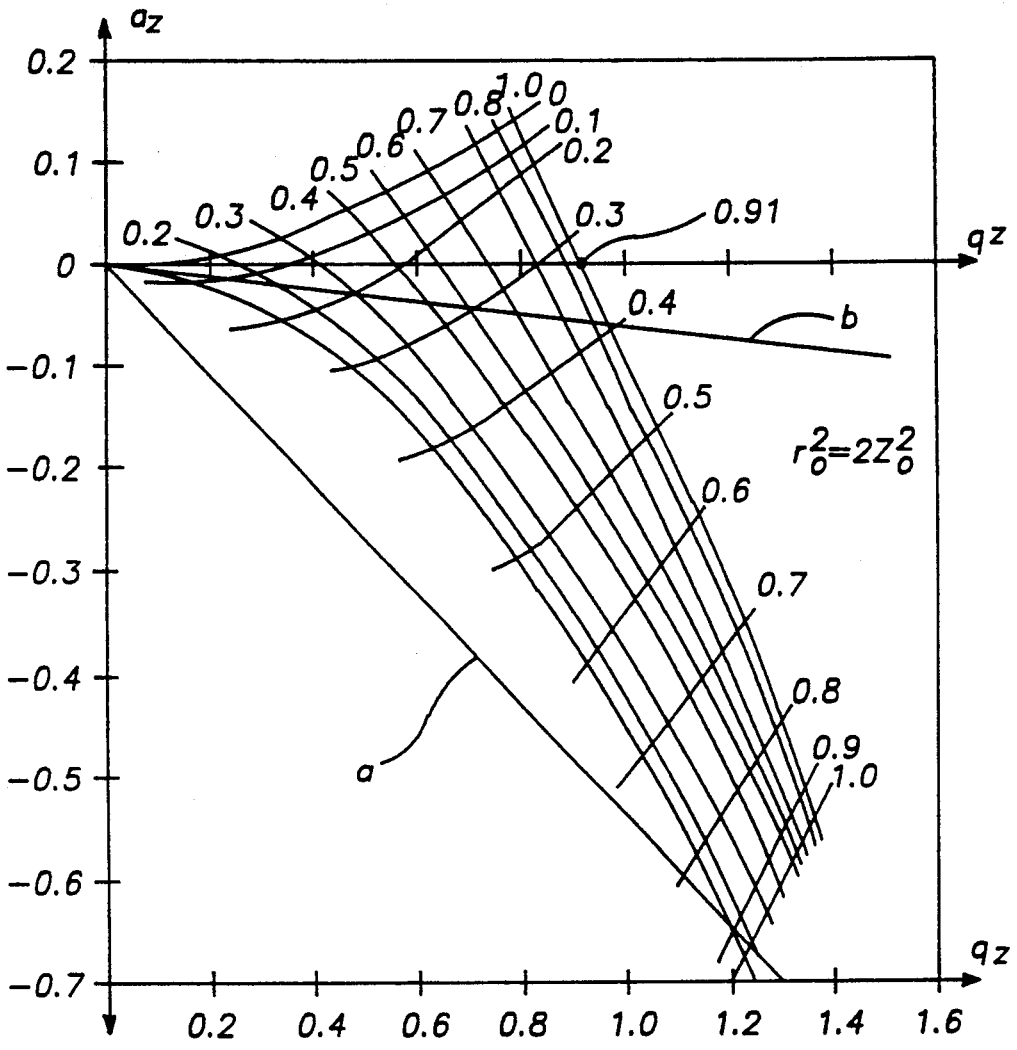
FIG. 2 is the stability envelope for the ion trap of the mass spectrometer shown in FIG. 1.

The symmetric fields in the ion trap 10 lead to the well known stability diagram shown in FIG. 2. The parameters a and q in FIG. 2 are defined as $$a=-8eU/mr_0^2\omega^2$$

$$q=4eV/mr_0^2\omega^2$$

where e and m are respectively charge on and mass of a charged particle. For any particular ion, the values of a and q must be within the stability envelope if it is to be trapped within the quadrupole fields of the ion trap device. This figure also shows iso-beta lines ($\beta$) where $\beta=2\omega_0/\omega$ and $\omega_0$ is the secular frequency of the ion's motion within the trapping field. In the mass-selective instability mode with resonance ejection, one typically scans the r.f. voltage, V, applied to the ring electrode while a supplementary voltage, $V_2$, of particular frequency described by $\beta_{z\text{-}eject}$ and amplitude is applied between the end-cap electrodes. The ions are thereby sequentially brought toward resonance at the selected beta line, oscillate along the axis of the trap with increased amplitude, and are ejected through perforations in an end-cap electrode to be detected by an external ion detector. This sequential ejection of ions according to their m/z value allows the determination of the m/z of the ions. This ejection occurs at a point away from the edge of the stability envelope.

However, there are many other ways to apply and scan the applied fields which can equivalently produce mass analysis using mass-selective instability with resonance ejection. For example, the supplementary voltage, $V_2$, might be applied to only one of the end caps. Alternatively, the r.f. voltage, V, may be applied to the two end caps while the supplementary voltage, $V_2$, is applied to the ring electrode. Through the use of a DC voltage component applied to the ring electrode, the ion ejection may be caused to occur at some point in the stability diagram other than along the $a_z=0$ axis. Thus, the r.f. voltage might remain constant during the mass analysis while the DC voltage is increased (or decreased) to successively bring ions toward resonance. Lastly, the frequency of the supplementary voltage might be scanned to successively bring ions into resonance. More elaborate schemes are possible which all have the characteristic of successively bringing ions of increasing (or decreasing) m/z towards a resonance point in order to cause ejection, ion detection, and the determination of the ions' m/z values.

Figure 3:
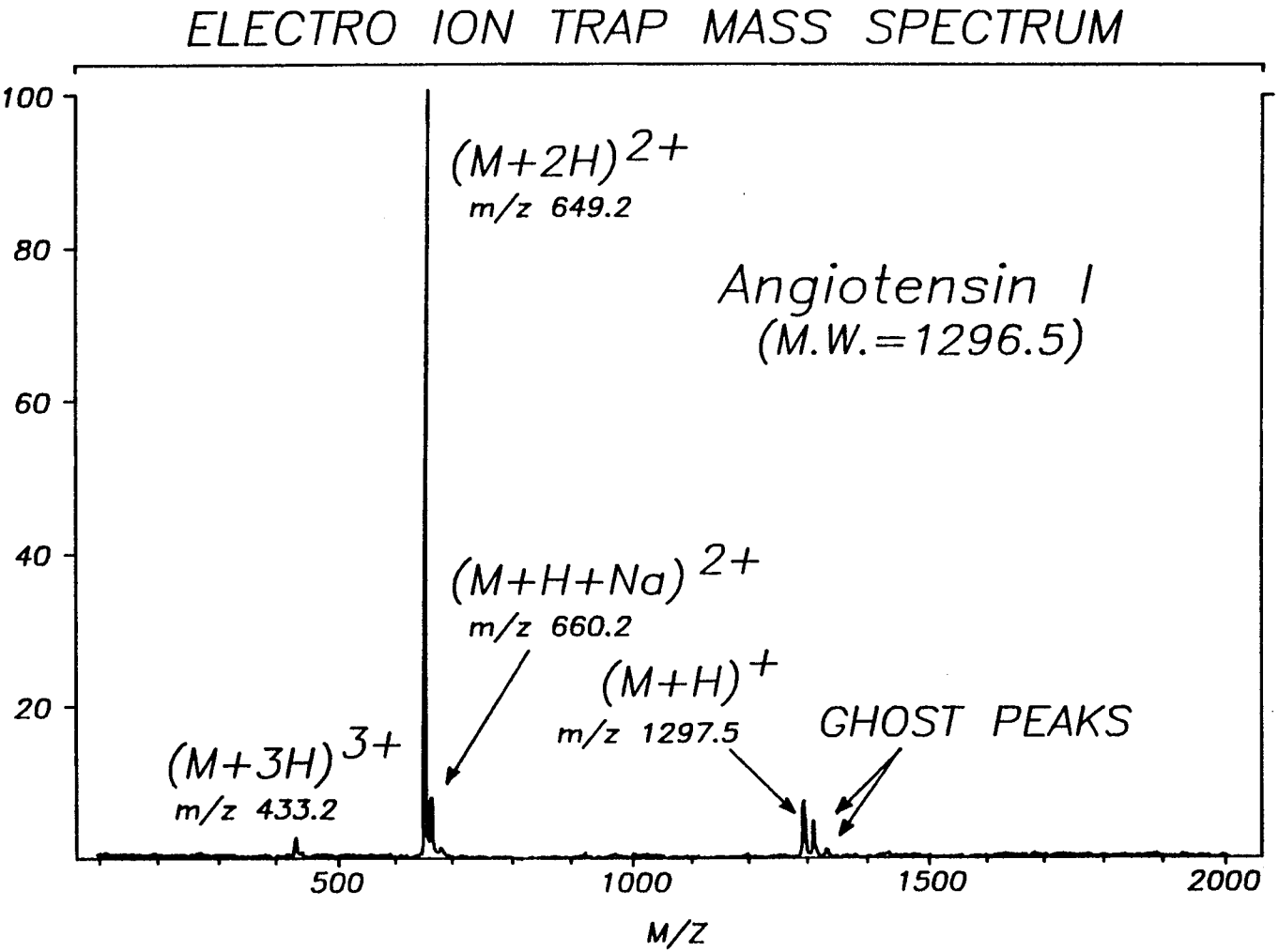
FIG. 3 is a mass spectrum of the peptide Angiotensin I obtained using the mass selective instability mode with resonance ejection. The resonance ejection frequency was 146,761 Hz and the bandpass of the electrometer was 15 kHz. The base peak is a doubly charged ion of m/z 649.2, but ions of this m/z also produce a ghost peak as they are ejected at the edge of the stability diagram.

An example of a mass spectrum obtained in a typical resonance ejection experiment in which the RF is scanned upward is shown in FIG. 3. The resonance ejection frequency was 146,761 Hz and the bandpass of the electrometer 27 was 15 kHz, a bandpass similar to the bandpass of the electrometers in all commercially available ion trap mass spectrometers. The base peak is a doubly charged ion of m/z 649.2, but ions of this m/z also produce a ghost peak as they are ejected at the edge of the stability diagram.

Until recently all ion trap mass spectra that were acquired using the mass selective instability mode (with or without resonance ejection) were acquired using a relatively low band-pass electrometer with a frequency response adequate to define the overall shape of each mass peak. In particular, all commercial instruments have been supplied with an electrometer with a 3 dB point of about 15 kHz, the frequency at which the output is attenuated to 71 percent of the output level given by an input of low frequency. Since the RF of the commercial instrument is scanned so that the mass peaks are ejected at a rate of 180 microseconds per mass peak, the analog section of the detection system is able to define the gross shape of the peak, but has little ability to provide detailed information about the details of the time dependence of ion ejection during the ejection of each mass peak. The digital data system is also of limited bandwidth and acquires a data point every 30 microseconds for a total of about 6 points per mass peak.

To obtain enhanced resolution with an extended mass range, we have recently begun to scan the trap so that each mass peak is ejected at rates much slower than the rate used in the commercial instrument and so that the resonance ejection frequency is much lower than that used in the commercial instrument. When using a particularly low resonance ejection frequency, less than 20 kHz, or less than 1/20 of the frequency used in the commercial instrument, we discovered that each mass peak consisted of a series of peaks or "ion packets."

Figure 4:
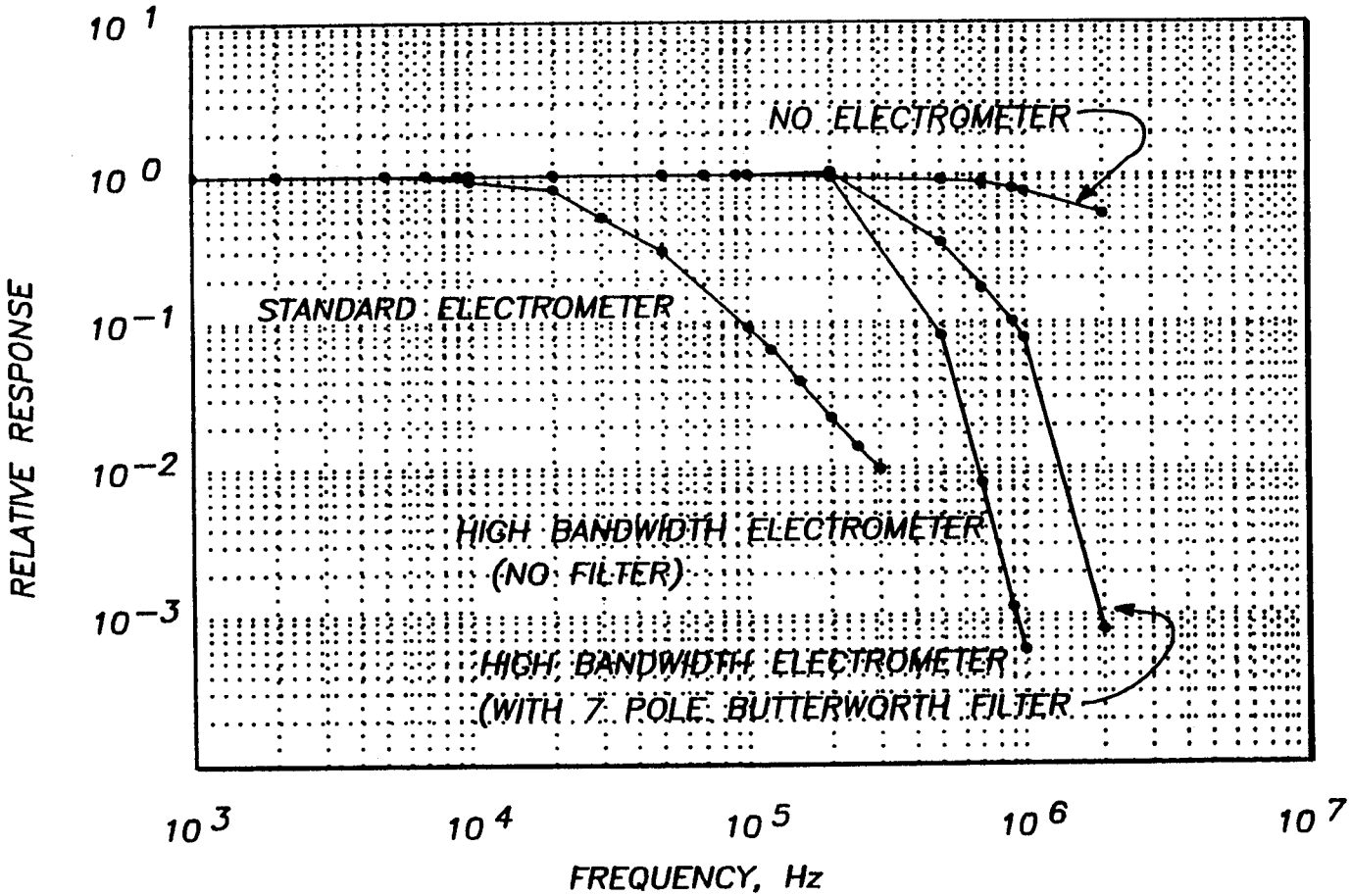
FIG. 4 shows the frequency response of the electrometers used to acquire the mass spectra.

Since the fine structure could be observed only during experiments with a very low resonance ejection frequency, we suspected that the bandpass of the detection system was limiting the ability to observe the phenomenon. We therefore built an electrometer with a bandpass of between 200 and 300 kHz and began using a digital oscilloscope, with a bandpass and digital bandpass of up to 1 Gigahertz, to acquire the output of the electrometer. FIG. 4 shows a comparison of the frequency response of the standard electrometer and the high bandwidth electrometer.

Figure 5:
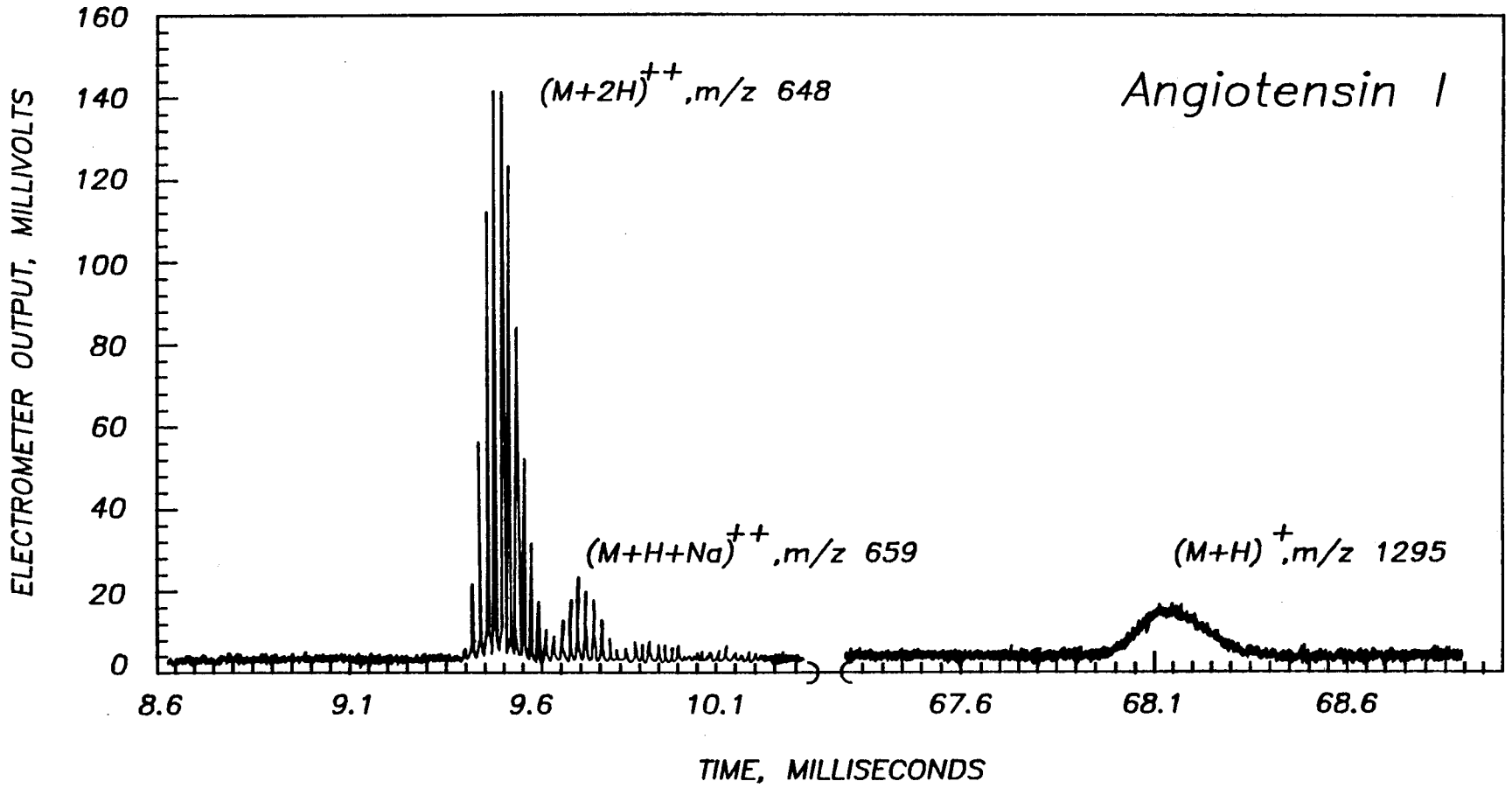
FIG. 5 shows a mass spectrum of the peptide Angiotensin I, as observed using a resonance ejection frequency of 50,000 kHz and a high band-width electrometer to observe the fine structure of the peaks. The peak at m/z 648 is a resonance ejection peak, and the peak at m/z 1295 results from ejection at the edge of the stability diagram.
Figure 6A:
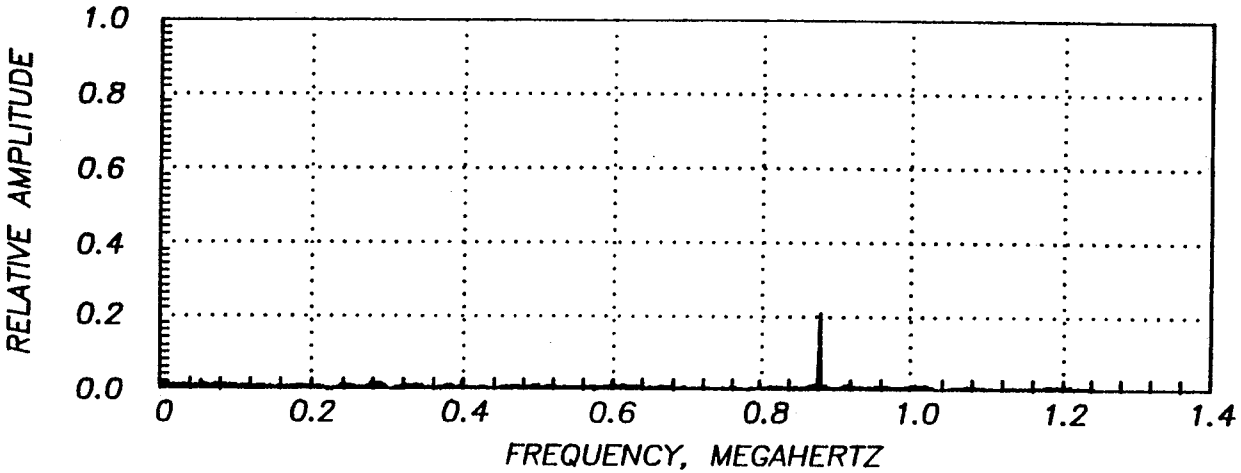
FIG. 6*a* shows the frequency spectrum of the m/z 1295 peak of FIG. 5.
Figure 6B:
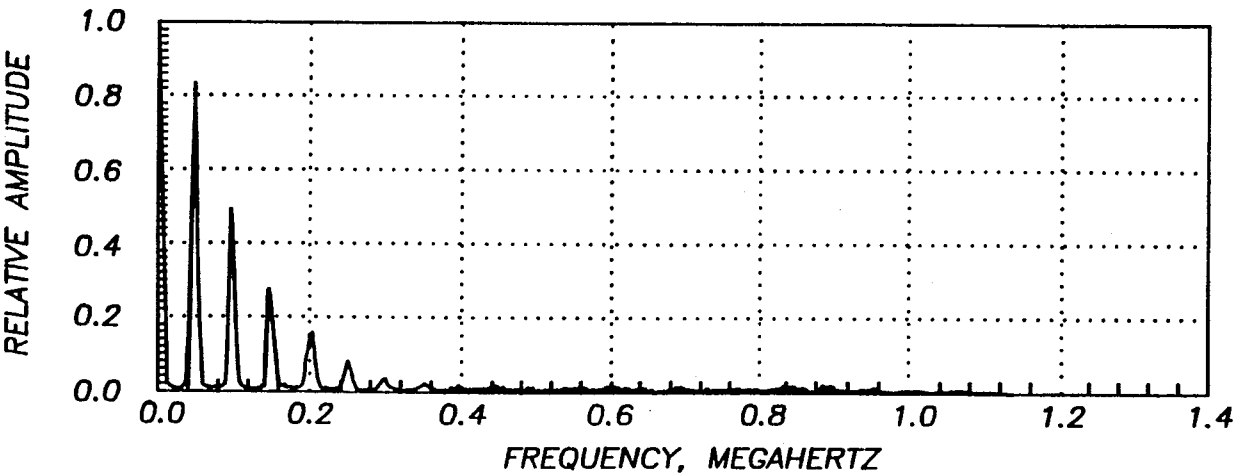
FIG. 6*b* shows the frequency spectrum of the m/z 648 peak. The frequency spectra were obtained by the Fourier transform of the two peaks in FIG. 5.

FIG. 5 shows a mass spectrum of the peptide angiotensin I acquired using the high bandwidth acquisition system. The doubly charged ion of m/z 648 was ejected by resonance ejection, at 50 kHz, in a trap with an RF frequency of 880 kHz. The peak at m/z 1295 was ejected at the edge of the stability diagram. The m/z 648 peak shows a series of ion packets, but the m/z 1295 peak shows little obvious fine structure. FIG. 6*a* shows the frequency spectrum of the m/z 648 peak in FIG. 5, and FIG. 6*b* shows the frequency spectrum of the m/z 1295 peak. FIG. 6*b* shows that the ion packets in the m/z 648 peak appear at the frequency of the resonance ejection voltage (50 kHz), and the harmonics of this frequency. FIG. 6*b* shows that the m/z 1295 peak has a frequency component at 880 kHz, the trap RF frequency, but the Nyquist criterion of the data acquisition allowed a maximum frequency measurement of 1.4 MHz, so harmonics, if present, could not be observed.

Figure 8A:
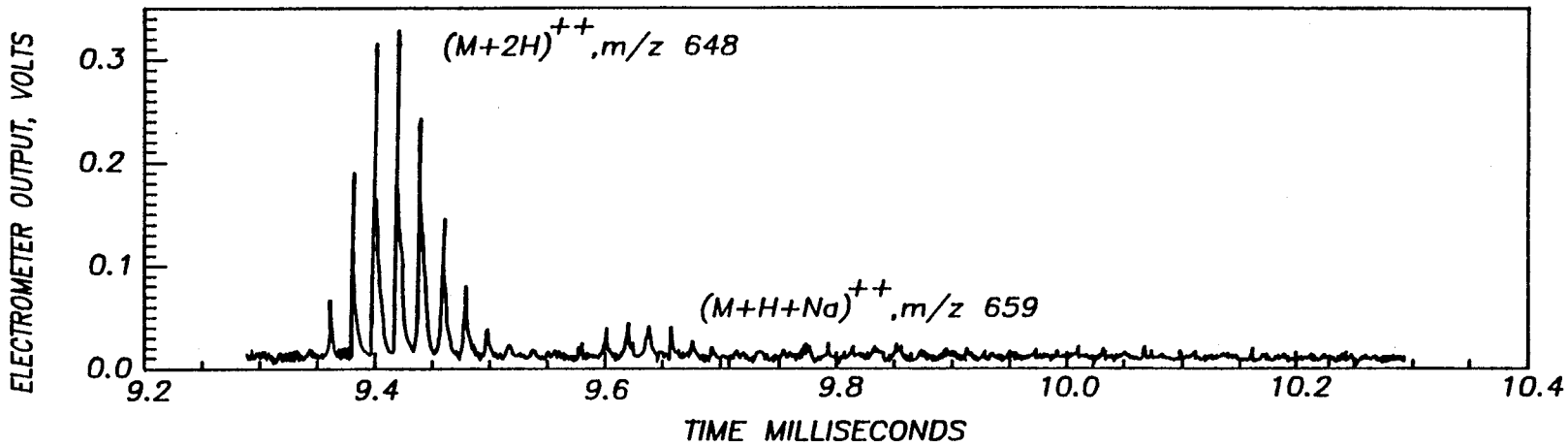
FIG. 8*a* shows the fine structure of a peak acquired under conditions of minimal space charge.
Figure 8B:
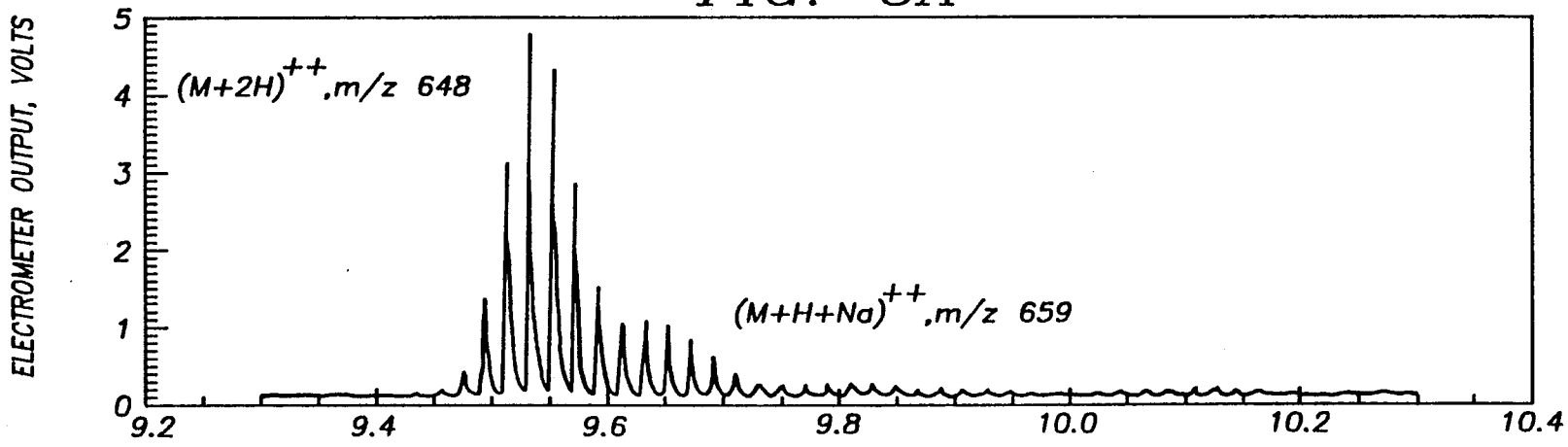
FIG. 8*b* shows the same peak when the ionization time was increased so that a sufficient number of ions were in the trap to create a condition of space charge.

Since the m/z resolution in an ion trap mass spectrum is known to degrade when a condition of space charge exists (the gross peak shape becomes broad), the question exists whether the peak fine structure of FIG. 5 persists as space charge increases. FIG. 8*a* shows the m/z 648 peak when acquired with a 30 ms ionization time, and FIG. 8*b* shows the same peak when acquired with a 700 ms ionization time. The large shift in position in the m/z 648 peak, relative to the m/z 659 peak, indicates that the peak is ejected under a condition of space charge, but the fine structure of the peak is essentially the same as when ejected with little space charge.

Figure 9A:
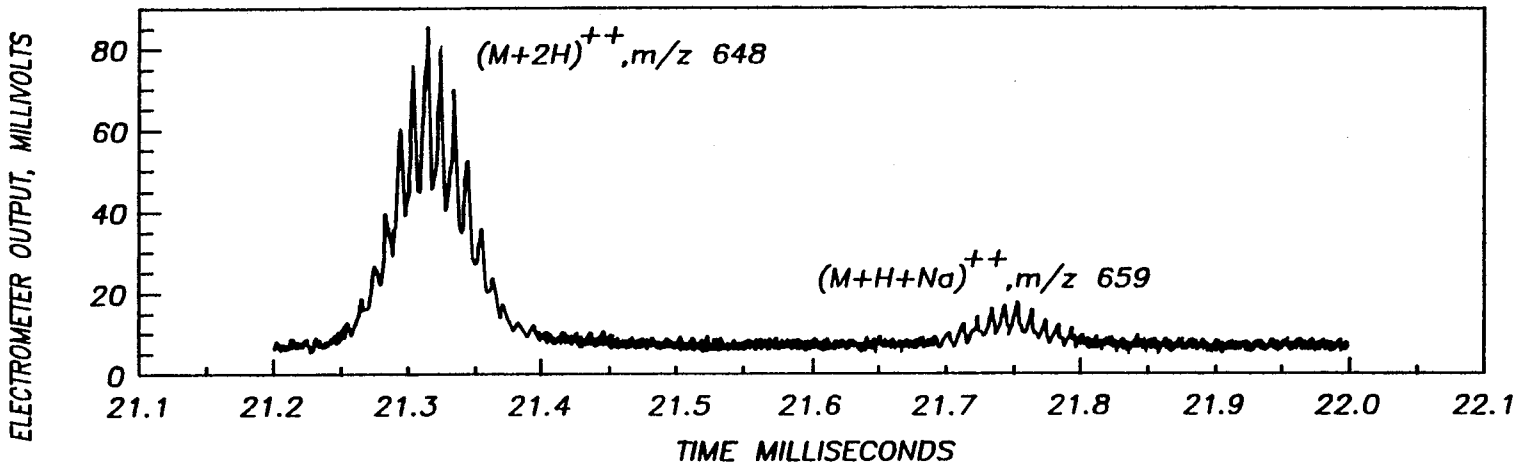
FIG. 9*a* shows a spectrum acquired with the standard pressure (a nominal, gauge pressure of about $7\times10^{-1}$ Pa)
Figure 9B:
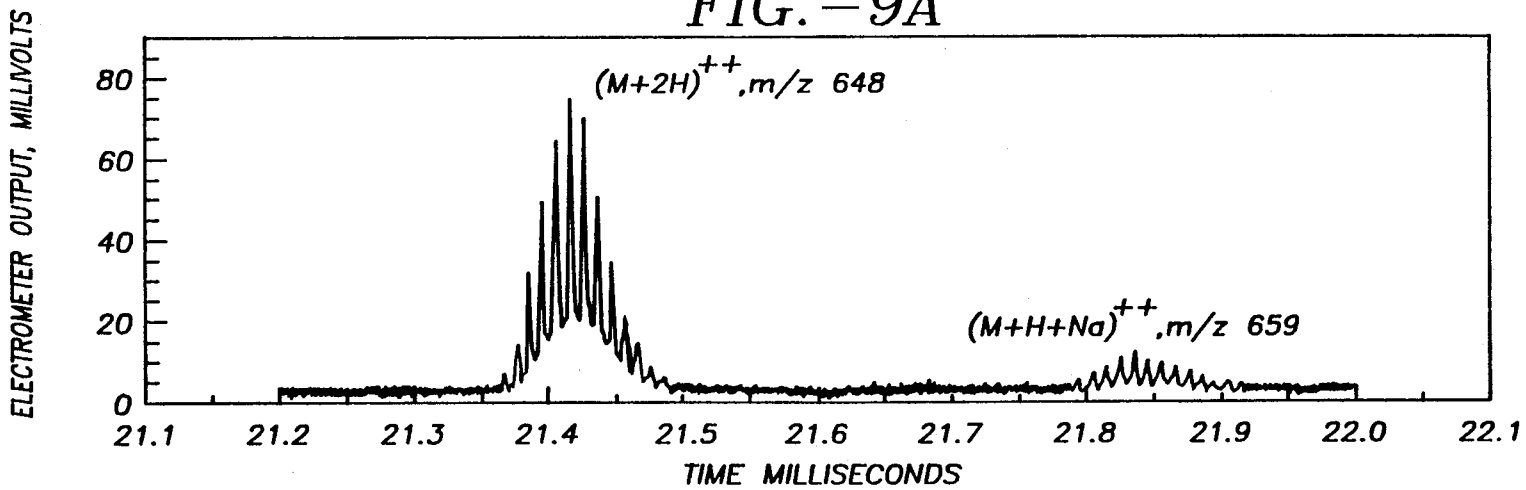
FIG. 9*b* shows the spectrum acquired at lower pressure (a nominal, gauge pressure of $2.8\times10^{-3}$ Pa). The fine structure is more pronounced at the lower pressure, but is still present at the standard operating pressure.

Since the source of the ion packets is evidently the coherence of the ion motion induced by the resonance ejection voltage, collisions with buffer gas or other gases could destroy the peak fine structure. We find that lower pressures do in fact favor the existence of the peak fine structure, but that at the standard operating pressure the fine structure is in fact present. FIG. 9*a* shows a spectrum acquired with the standard pressure (a nominal, gauge pressure of about $7\times10^{-3}$ Pa), and FIG. 9*b* shows the spectrum acquired at lower pressure (a nominal, gauge pressure of $2.8\times10^{-3}$ Pa). The fine structure is more pronounced at the lower pressure, but is still present at the standard operating pressure.

Figure 7A:
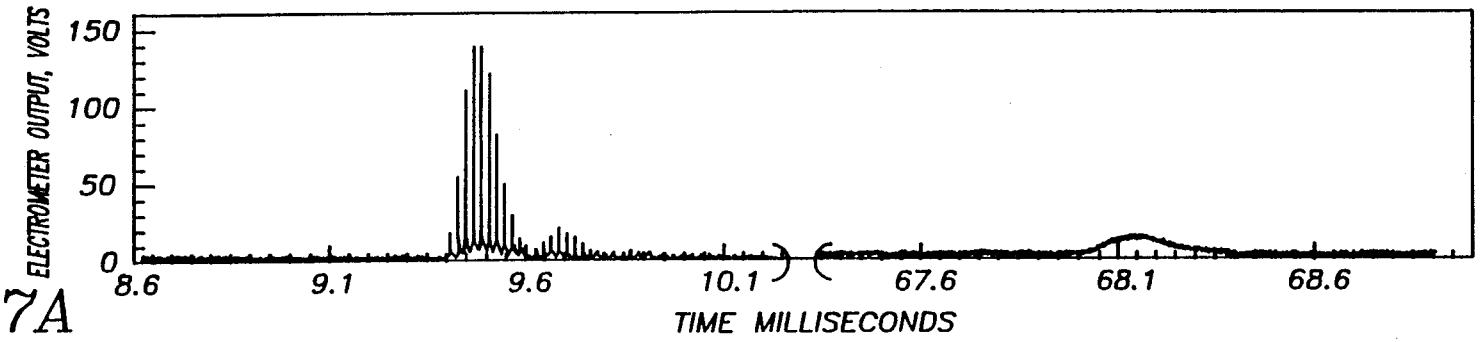
FIG. 7*a* shows the mass spectrum of FIG. 5.
Figure 7B:
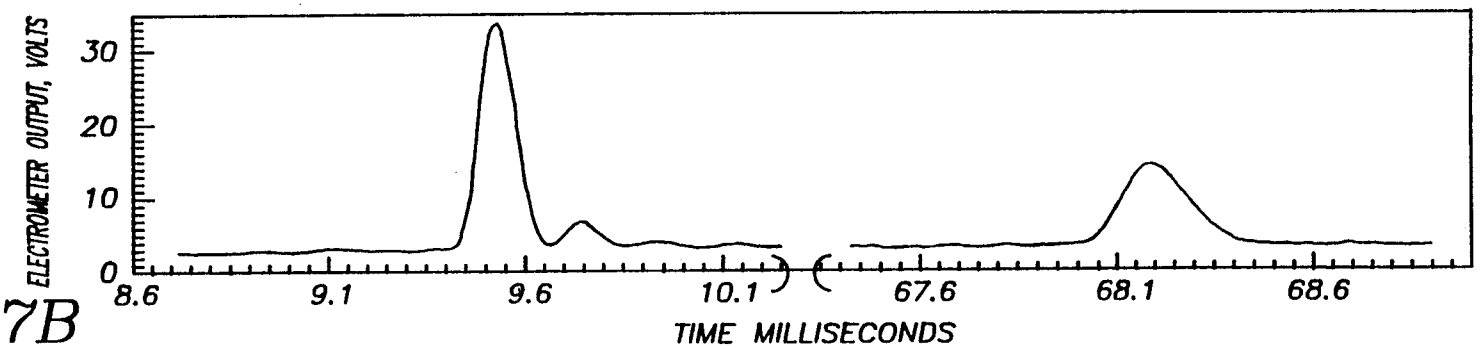
FIG. 7*b* shows the result of filtering FIG. 7*a* with a 15 kHz low-pass filter.
Figure 7C:
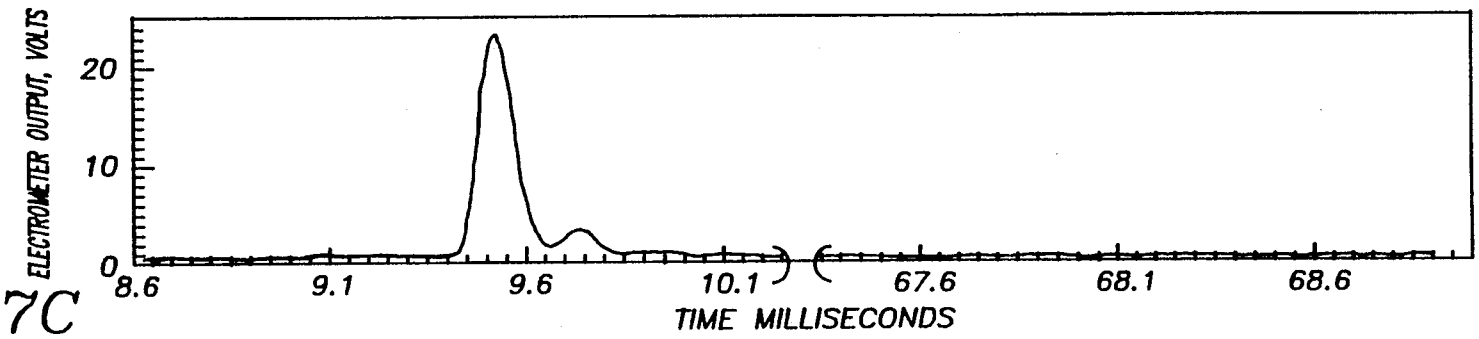
FIG. 7*c* shows the result of the 50 kHz demodulation procedure described in the text.

The discovery that the frequency spectrum of peaks ejected by resonance ejection is distinct from the frequency spectrum of peaks ejected at the edge of the stability diagram allows a practical method of distinguishing the two types of peaks. FIG. 7c shows the result of one method of distinguishing the peaks. The spectrum, as acquired by the high bandwidth electrometer and digital oscilloscope, is shown in FIG. 7a. The result of applying a digital low-pass filter (with a bandwidth of 15 kHz) to FIG. 7a is shown in FIG. 7b. The fine structure is no longer evident, and the spectrum appears much as it would if it had been acquired with the standard electrometer. This shows the need for a high bandwidth electrometer.

FIG. 7c was prepared by processing the data of FIG. 7a in such a way that the two types of peaks could be distinguished. In particular, the spectrum was processed so that only information appearing at the frequency of the resonance ejection voltage would result in a response. The processing of the data of FIG. 7a to produce FIG. 7c is essentially a digital demodulation using the frequency of the axial modulation as the center frequency. The steps were: 1) the signal of FIG. 7a was first multiplied by sin (50000*2πt), and the result of this multiplication was squared; 2) the signal of FIG. 7a was separately multiplied by cos (50000*2πt), and the result of this multiplication was likewise squared; and 3) the square root of the sum of the two squares was then filtered at 15 kHz and the result was plotted, resulting in FIG. 7c. As shown, the peak from the ejection of m/z 1295 at the edge of the stability diagram has been eliminated.

An even broader utilization of the fact that we can distinguish peaks based on their resonance ejection frequency is to purposely use more than one resonance frequency with amplitudes sufficient for ejection. For example, since the mass range of the trap is readily extended by lowering the frequency at which resonance occurs, two different mass ranges may be simultaneously recorded by simultaneously using two frequencies. When using very low resonance ejection frequencies very high mass-to-charge ranges are accessible. However, practically, there is a limitation in the lowest mass-to-charge which is observable. The peaks arising from the two different resonance lines will be interspersed in the resulting spectrum, and the method of using the fine structure of an ejected peak to determine the frequency at which it was ejected is generally applicable and may be used with these more complex waveforms.

Figure 10:
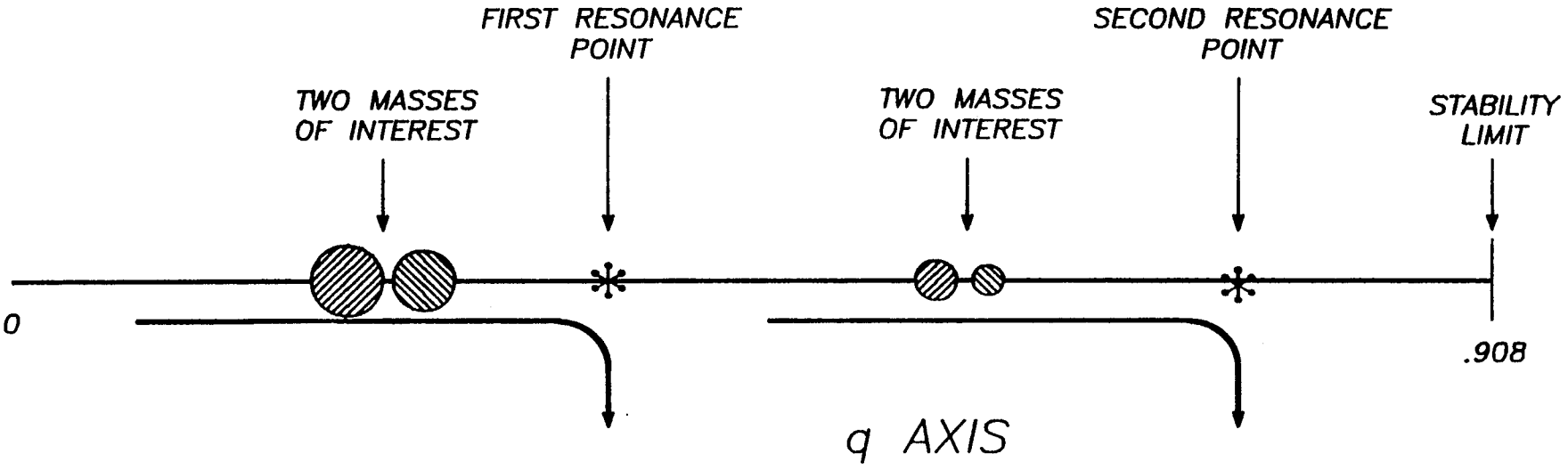
FIG. 10 gives a schematic representation of a mass selective instability scan with resonance ejection in which two resonance ejection frequencies are used instead of one. Two resonance points are established and peaks within the resulting mass spectrum may be due to ejection at either point.

FIG. 10 shows such an experiment in schematic form. In this experiment, the resonance ejection voltage is the sum of two sinusoidal voltages so that there are two resonance points on the q axis at which resonance ejection will occur. As shown in the figure, at the start of the experiment two masses have q values such that they will be brought into resonance at the first resonance point while two other masses have q values that will result in them being brought into resonance at the second resonance point. During the experiment, the RF voltage is scanned and the detector records peaks resulting from ejection at both resonance points.

Figure 11A:
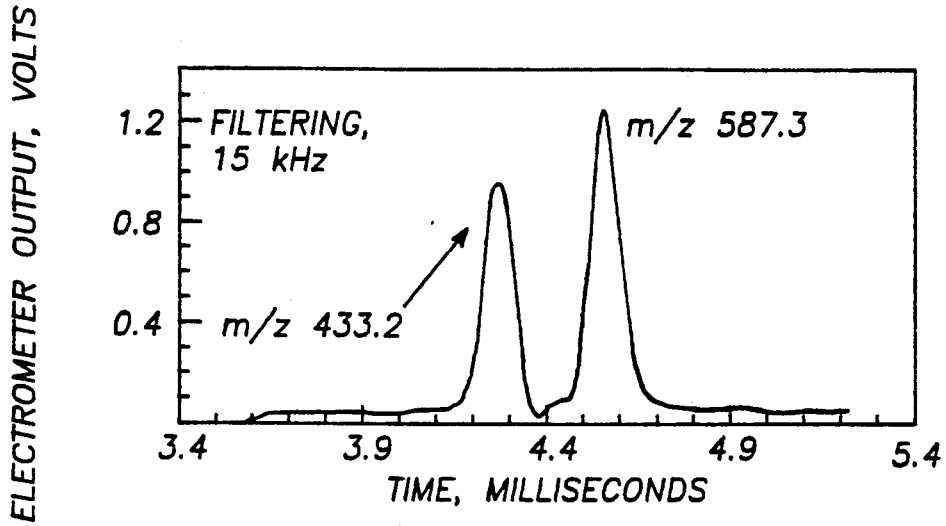
FIGS. 11*a* and 11*d* show the result of a 15 kHz lowpass filter on the spectrum.

FIG. 11a shows the result of such an experiment in which two resonance ejection frequencies were used, 30 kHz and 100 kHz, and the electrometer output is simply filtered with a 15 kHz low pass filter. The peaks of m/z 433.2 and 587.3 (from multiply charged ions) are ejected at the first resonance point (30 kHz) and the peaks at m/z 649.2 and 880.5 are ejected at the second resonance point. The peaks obtained using such a low bandpass acquisition are indistinguishable.

Unlike the peaks from a low bandpass acquisition, the peaks resulting from a high bandpass acquisition can be distinguished by inspection. However, in a two frequency experiment we find that more reliable results are obtained by acquiring the spectrum using different phase relationships between the two resonance ejection frequencies and then summing the resulting electrometer outputs. FIG. 12 shows the fine structure of the m/z433.2 and the m/z587.3 peaks acquired using four different phase relationships between the two resonance ejection frequencies.

Figure 12A:
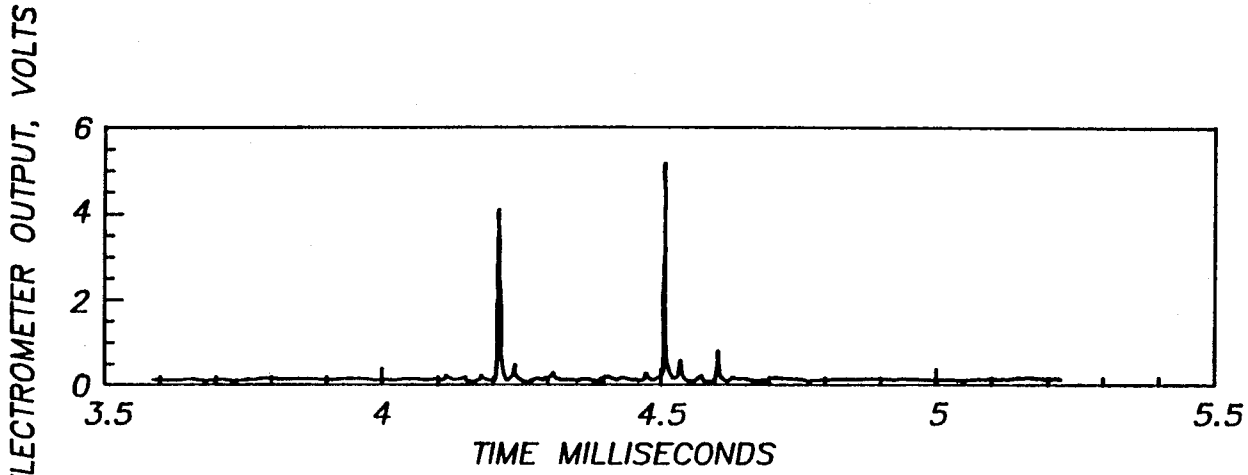
FIG. 12*a* shows the fine structure of the peaks ejected at 30 kHz, for acquisitions using four different phase relationships between the two resonance ejection frequencies.
Figure 12B:
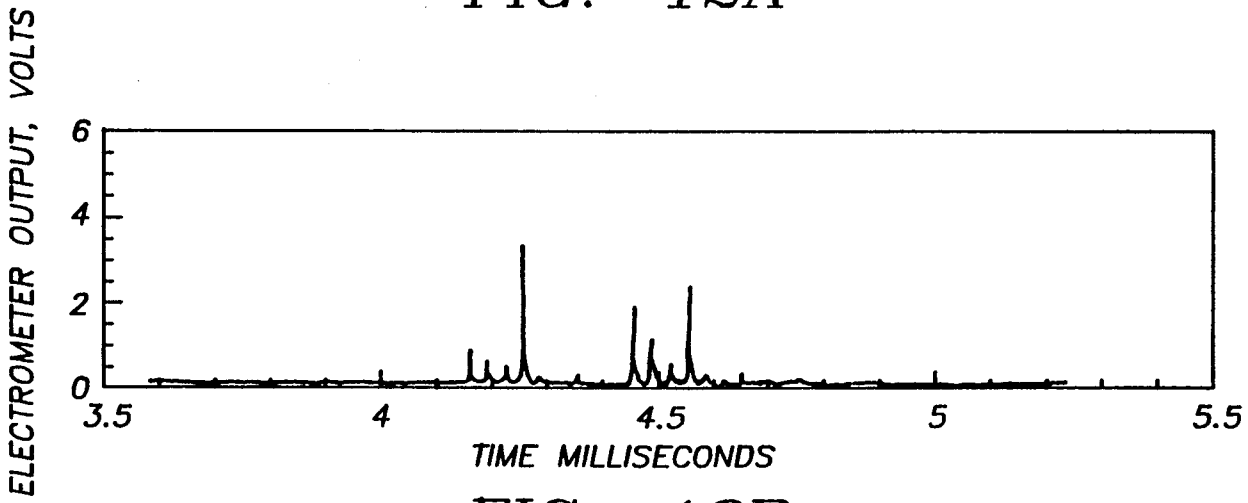
FIG. 12*b*, voltage $=-\sin(30000*2\pi*t)+5\sin(100000*2\pi*t)$.
Figure 12C:
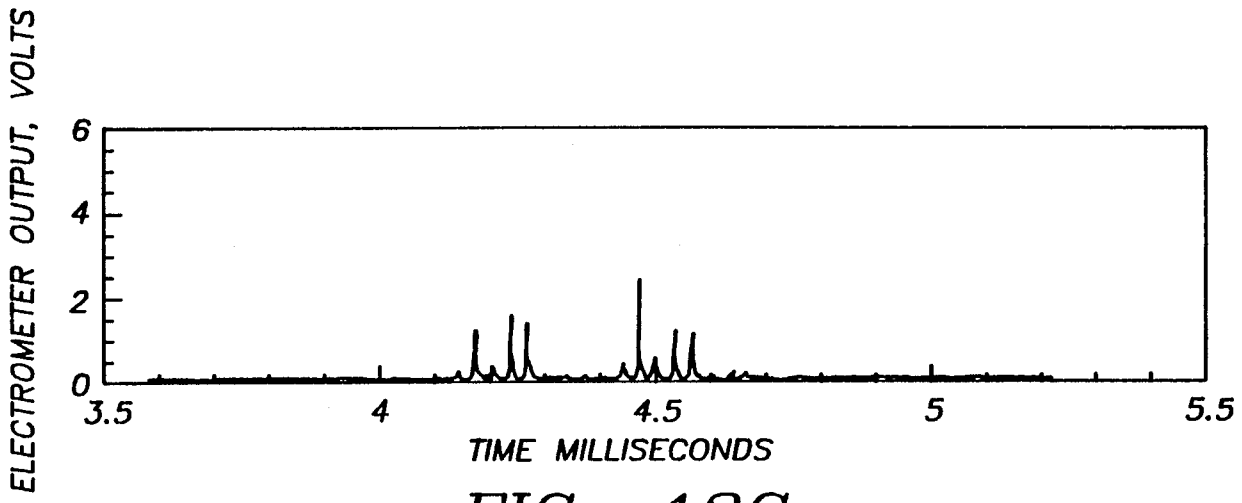
FIG. 12*c*, voltage $=+\sin(30000*2\pi*t)-5\sin(100000*2\pi*t)$; and, FIG. 12*d*, voltage $=-\sin(30000*2\pi*t)-5\sin(100000*2\pi*t)$.
Figure 12D:
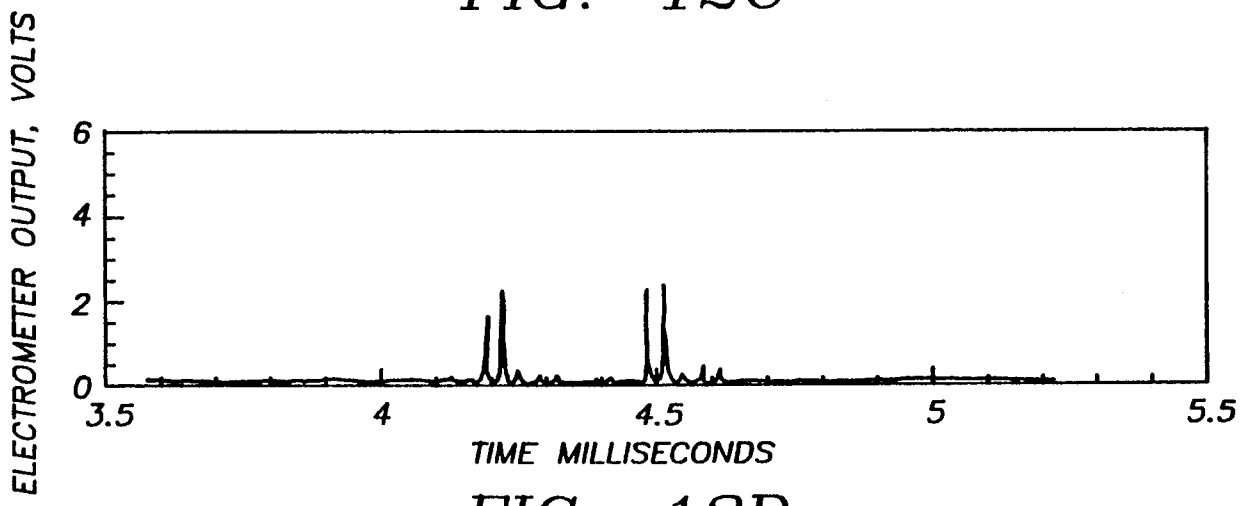

An "arbitrary waveform generator" was used to produce the resonance ejection voltage. This device uses a table look-up to determine the voltage to output at a given time, so the relative phase of the two resonance ejection signals can be readily controlled. The tables were calculated according to the following formulae: FIG. 12a, voltage=+sin (30000*2π*t)+5 sin (100000*2π*t); FIG. 12b, voltage=−sin (30000*2π*t)+5 sin (100000*2π*t); FIG. 12c, voltage=+sin (30000*2π*t)−5 sin (100000*2π*t); and, FIG. 12d, voltage=−sin (30000*2π*t)−5 sin (100000*2π*t).

Inspection of the four spectra of FIG. 12 shows that the ions are ejected at the 33.3 microsecond interval expected with a resonance ejection frequency of 30 kHz, but that the relative amplitude of successive ejections does not show the roughly triangular envelope of a single-frequency spectrum (such as the m/z 648 peak of FIG. 5). Apparently, the 100 kHz signal modulates the amplitude by influencing whether the ions will be ejected at the maximum excursion of a particular oscillation. For example, if the component of the 100 kHz signal on the ion-ejection end cap is positive and large at the time when the resonance oscillation due to resonance at 30 kHz would otherwise be large enough to cause ejection and detection, ejection may be suppressed. Conversely, a negative voltage may promote ejection.

Figure 13:
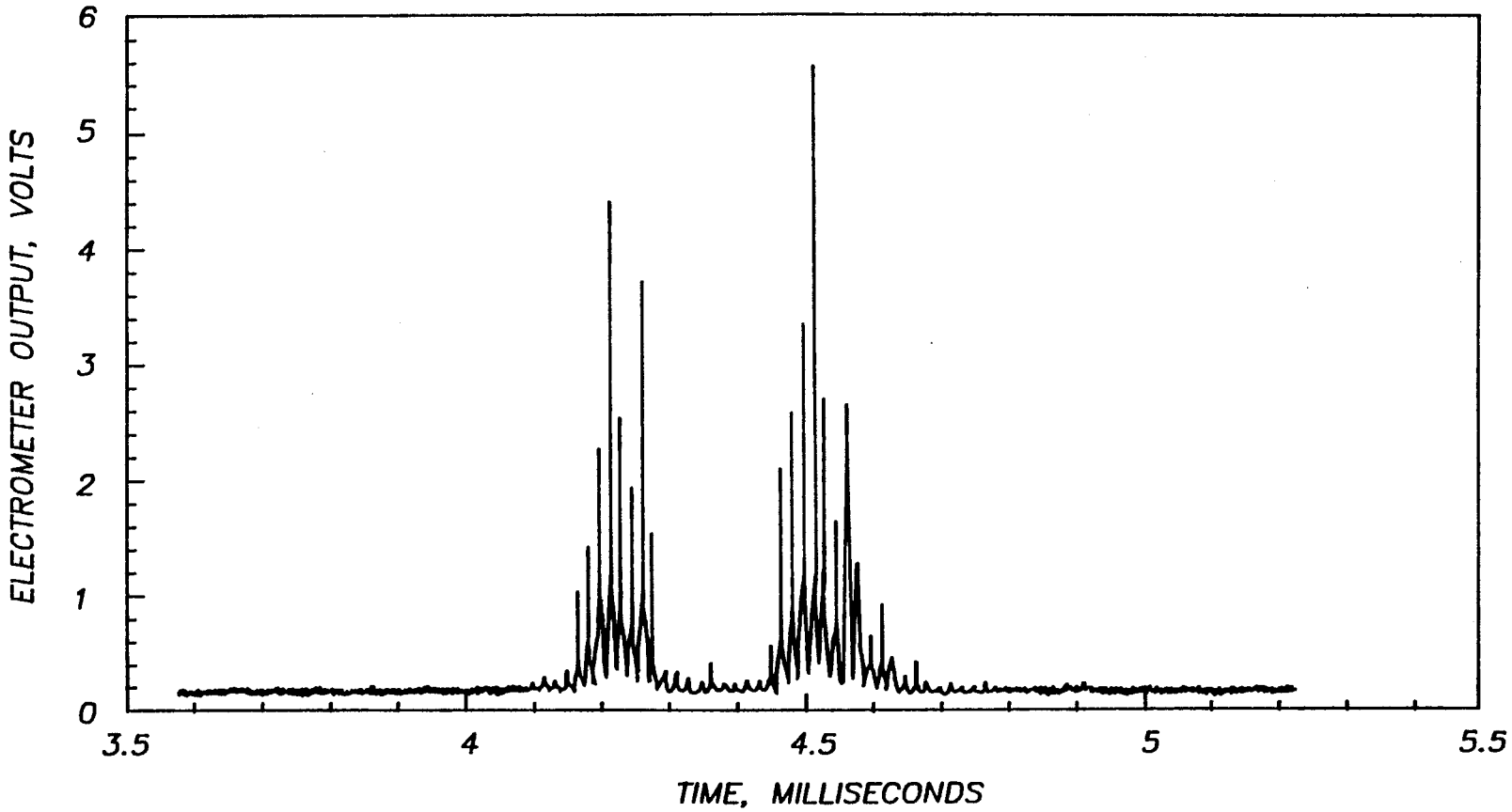
FIG. 13 is the sum of the four spectra shown in FIG. 12.
Figure 14A:
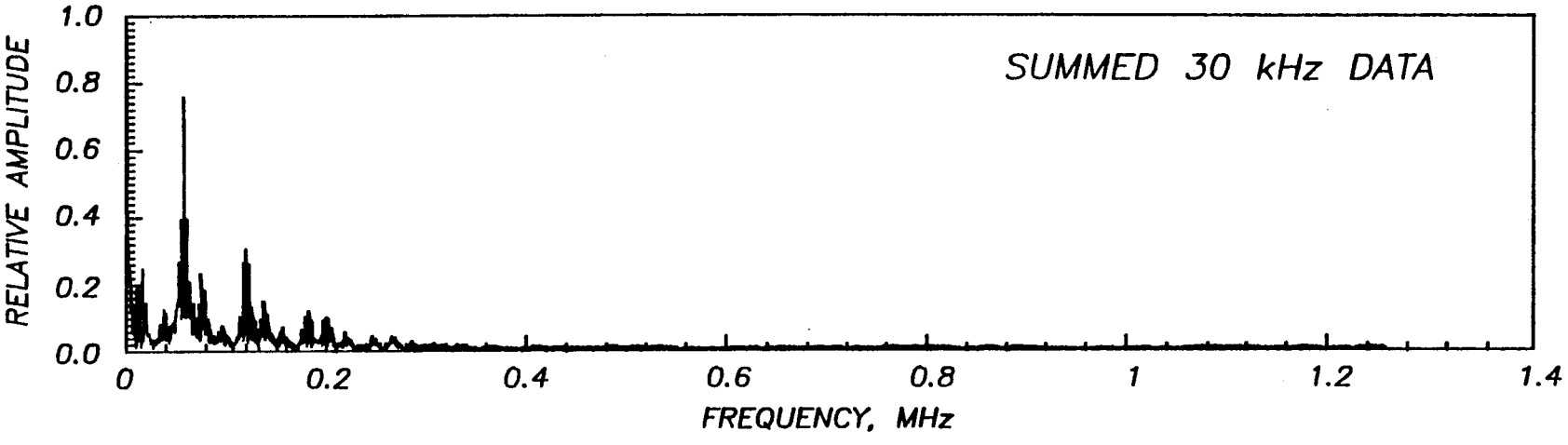
FIG. 14*a* shows the Fourier transform of the peaks in FIG. 13.
Figure 14B:
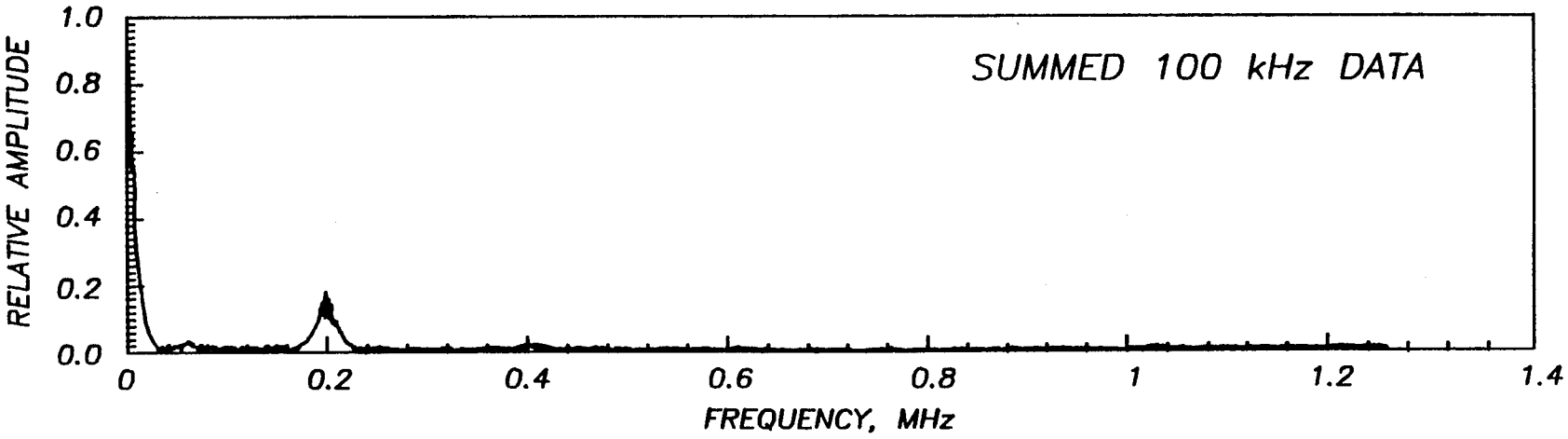
FIG. 14*b* shows the Fourier transform of the peaks ejected at 100 kHz.

The effect of this added modulation is to reduce the information content at a particular frequency (e.g. at 30 kHz). One way of circumventing this problem is to sum the electrometer output data obtained using the various phase relationships. For example, FIG. 13 shows the sum of FIGS. 12a–12d; A much smoother peak envelope is obtained than from any of the spectra of FIG. 12. The frequency spectrum of FIG. 13 is given in FIG. 14a, and the frequency spectrum of the corresponding data for the peak at m/z 649.2 is shown in FIG. 14b. The frequency spectrum in FIG. 14a shows that the most intense frequency component is at 60 kHz; similarly, FIG. 14b shows its most intense frequency component at 200 kHz. The apparent frequency doubling results from summing (always positive) spectra that are 180 degrees out of phase.

Figure 11B:
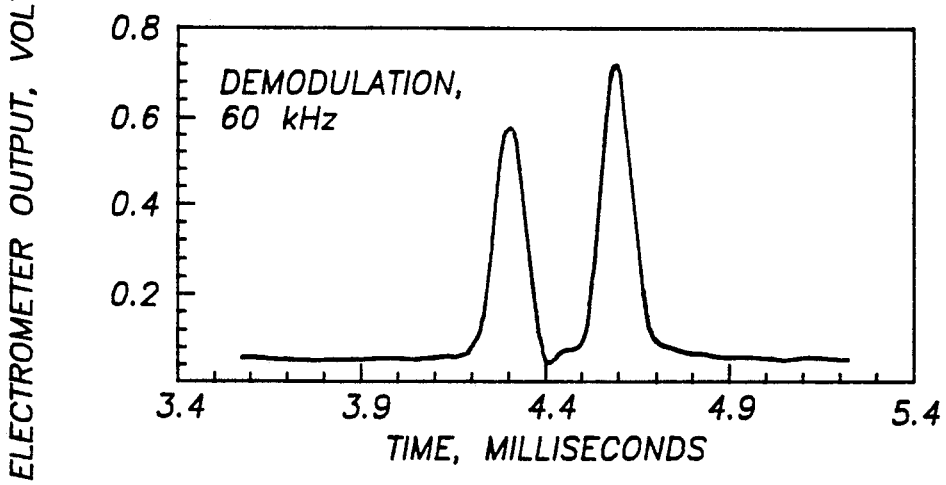
FIGS. 11*b* and 11*e* show the result of demodulation using 60 kHz as the demodulation frequency.
Figure 11C:
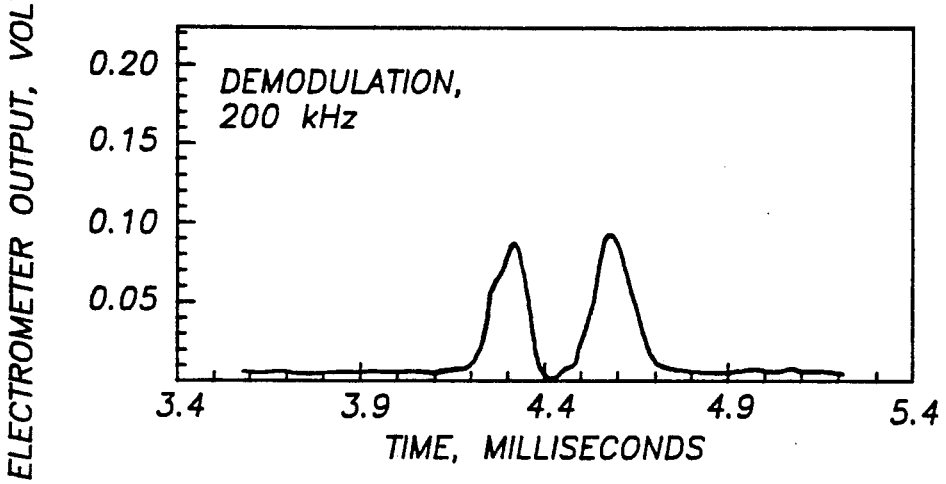
FIGS. 11*c* and 11*f* show the result of a similar demodulation using 200 kHz as the demodulation frequency.
Figure 11D:
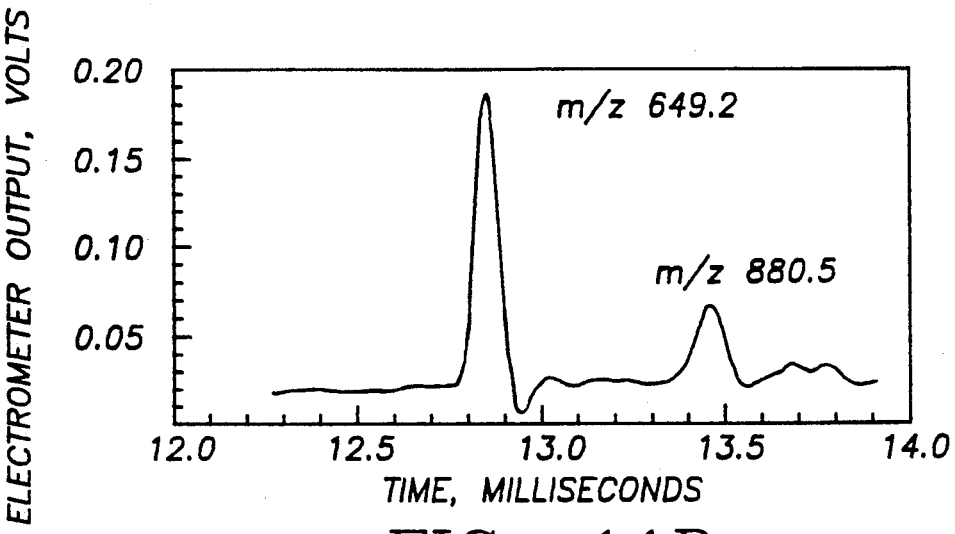
Figure 11E:
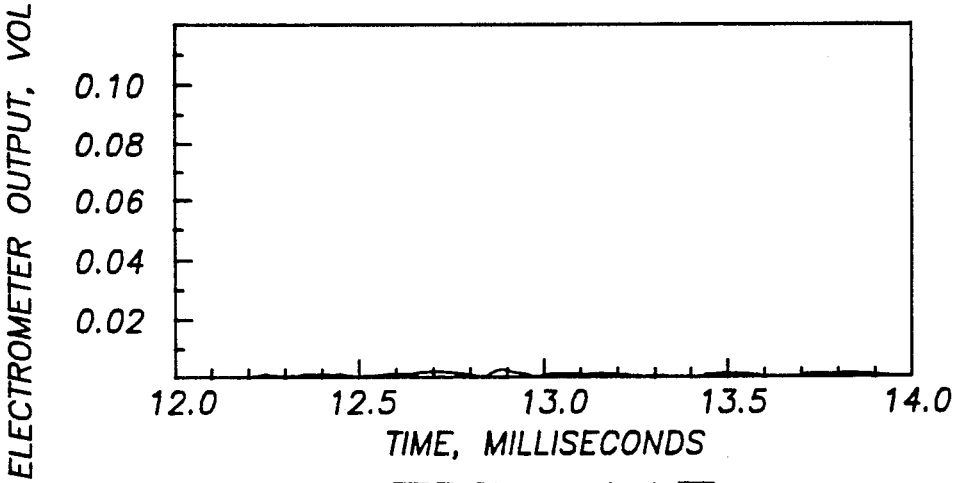
Figure 11F:
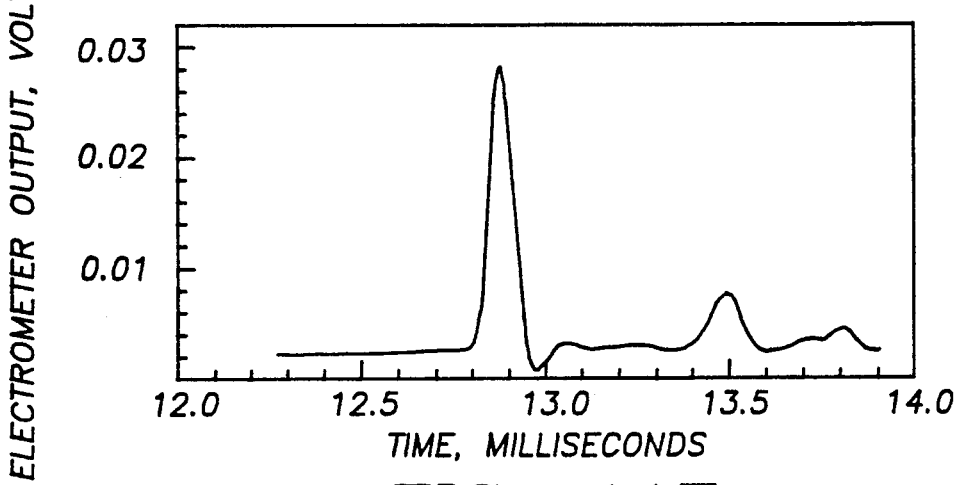

FIG. 11b shows the result of performing a demodulation on the summed spectra using 60 kHz as the demodulation frequency. The peaks ejected with the 100 kHz resonance ejection voltage (m/z 649.2 and m/z 880.5) are cleanly removed. The results of a similar demodulation using a 200 kHz demodulation frequency is shown in FIG. 11c. The peaks ejected with the 30 kHz resonance ejection voltage (m/z 433.2 and m/z 587.3) are attenuated relative to the 100 kHz peaks, but they are not cleanly removed. These peaks were not entirely removed because of the considerable frequency component in their frequency spectrum at 200 kHz, as seen by inspection of FIG. 14a. Despite the complete removal of the 30 kHz peaks, the procedure is still useful to determine the nature of the ejected peaks.

The "sum-squares" method of determining the amount of information at a particular frequency is well known. Formally, if a time varying signal (such as the electrometer output from an ion trap mass spectrometer) is represented by S(t), then the information at a particular frequency f and phase $\rho$ may be determined by forming the product $S(t)^* \sin(f^*2\pi t+\rho)$, and then filtering the result. Essentially, S(t) is mixed down to zero frequency and other frequencies are removed using a low pass filter. If the optimum phase, $\rho$, for mixing is not known, then the mixing can be performed using two phases that differ by 90 degrees, and a phase-independent magnitude can be determined by the square root of the sum of the squares of the two results: magnitude $=\sqrt{((S(t)^* \sin(f^*2\pi t+\rho))^2+(S(t)^* \sin(f^*2\pi t+\rho))^2)}$. The "sum-squares" procedure given above essentially determines the magnitude at the frequency of interest. An even higher degree of discrimination can be obtained by using both the frequency and the phase of the ion packets. This is accomplished by multiplying the spectrum by $\sin(50000^*2\pi t+\rho)$, and then applying a low-pass filter, rather than using the square root of the sum of the squares of the sin and cos components. An appropriate choice of the phase, $\rho$, can provide considerable discrimination, but we have found that the procedure is complicated by a variation of the phase of the ion packets with mass.

Many other types of signal processing may be used for this and similar purposes (either analog or digital), but they are all based on using the fine structure of the resonance ejection peaks. For example, an appropriate lock-in amplifier could be used to provide a response only at the frequency of the resonance ejection voltage.

The ability to perform parent and neutral loss scans is based on a two frequency experiment. In both scan types the first frequency is scanned through a chosen mass range and has an appropriate amplitude to excite and dissociate encountered ions but theoretically not enough to eject them. The second frequency has an amplitude sufficient to resonantly eject ions for detection and is either fixed at a frequency of a particular daughter ion, for a parent scan, or swept through frequencies corresponding to masses related to the first frequency by a fixed mass difference for a neutral loss scan. However, in practice the first excitation frequency as it scans can cause ejection to occur and will result in spurious peaks in the spectrum. By only detecting at the second resonance ejection frequency these spurious peaks would be eliminated since they would all have a different ejection frequency than the second frequency used for ejection.

What is claimed:

1. The method of operating an ion trap mass spectrometer comprising the steps of defining a trap volume with a three-dimensional substantially quadrupole field for trapping ions within a predetermined range of mass-to-charge ratio, forming within or injecting ions into said trap volume such that those within said predetermined mass-to-charge ratio range are trapped, applying a supplementary AC field superimposed on said three-dimensional quadrupole field to form combined fields, changing said combined fields to sequentially resonantly eject ions from said trap volume for detecting ejected ions and generating an output signal in which the output signal of said resonantly ejected ions has a frequency component at the frequency of said supplementary AC field.

2. The method as in claim 1 including the step of processing said signal to identify signal components having said frequency components to thereby identify said resonantly ejected ions.

3. The method as in claim 2 in which said step of processing includes amplifying the signal with a lock-in amplifier.

4. The method as in claim 2 in which said signal is digitally processed to identify the resonantly ejected ions.

5. The method as in claim 2 in which the signal is processed by multiplying by $\sin(f2\pi t+\rho)$ to identify the resonantly ejected ions.

6. The method as in claim 2 in which the signal is processed by calculating $\sqrt{((S(t)^* \sin(f^*2\pi t+\rho))^2+(S(t)^* \cos(f^*2\pi t+\rho)^2)}$, where S(t) is the time at which each point is acquired.

7. The method as in any one of claims 1, 2, 3, 4, 5 or 6 in which the processed signal is plotted to provide a mass spectrum.

8. The method of operating an ion trap mass spectrometer in the mass selective instability mode with resonance ejection which comprises applying a supplementary AC field at a selected frequency, whereby the resonantly ejected ions have an ejection frequency component at said selected frequency, detecting the ejected ions and providing an output signal which includes a component having said selected frequency to identify said resonantly ejected ions.

9. The method of operating an ion trap in the mass selective instability mode with resonant ejection of ions which comprises detecting all ejected ions including resontantly ejected and non-resonantly ejected ions, and identifying the resonantly ejected ions.

10. The method of operating an ion trap mass spectrometer comprising the steps of defining a trap volume with a three-dimensional substantially quadrupole field for trapping ions within a predetermined range of mass-to-charge ratio, forming within or injecting ions into said trap volume such that those within said predetermined mass-to-charge ratio range are trapped, applying at least two supplementary AC fields at different frequencies superimposed on said three-dimensional quadrupole field to form combined fields, changing said combined fields to sequentially resonantly eject ions from said trap volume for detecting ejected ions and generating an output signal in which the output signal of said resonantly ejected ions has a frequency component at the frequency of at least one of said supplementary AC fields.

11. The method as in claim 10 including the step of processing said signal to identify signal components having said frequency components to thereby identify said resonantly ejected ions.

12. The method as in claim 11 in which said step of processing includes amplifying the signal with a lock-in amplifier.

13. The method as in claim 11 in which said signal is digitally processed to identify the resonantly ejected ions.

14. The method as in claim 11 in which the signal is processed by multiplying by sin $(f2\pi t+\rho)$ to identify the resonantly ejected ions.

15. The method as in claim 11 in which the signal is processed by calculating $\sqrt{((S(t)^* \sin (f^*2\pi t+\rho))^2+(S(t)^* \cos (f^*2\pi t+\rho)^2)}$, where S(t) is the time at which each point is acquired.

16. The method as in any one of claims 10, 11, 12, 13, 14 or 15 in which the processed signal is plotted to provide a mass spectrum.

17. The method of operating an ion trap mass spectrometer comprising the steps of defining a trap volume with a field for trapping ions within a predetermined range of mass-to-charge ratio, forming or injecting ions within said trap volume such that those within said predetermined mass-to-charge ratio range are trapped, applying a supplementary AC field superimposed on said field to form combined fields, changing said combined fields to sequentially resonantly eject ions of consecutive mass-to-charge ratio from said trap volume for detecting ejected ions and providing an output signal in which the output signal of said resonantly ejected ions has a frequency component at the frequency of said supplementary AC field.

18. The method of operating an ion trap mass spectrometer comprising the steps of defining a trap volume with a field for trapping ions within a predetermined range of mass-to-charge ratio, forming or injecting ions within said trap volume such that those within said predetermined mass-to-charge ratio range are trapped, applying at least two supplementary AC fields at different frequencies superimposed on said field to form combined fields, changing said combined fields to sequentially resonantly eject ions of consecutive mass-to-charge ratio from said trap volume for detecting ejected ions and providing an output signal in which the output signal of said resonantly ejected ions has a frequency component at the frequency of said supplementary AC field.

* * * * *